US006347579B1

(12) United States Patent
Houri et al.

(10) Patent No.: US 6,347,579 B1
(45) Date of Patent: Feb. 19, 2002

(54) HUSKING APPARATUS

(75) Inventors: Masahide Houri; Minoru Koreda; Takeshi Mito, all of Hiroshima (JP); Satoru Satake, *deceased*, late of Tokyo (JP), by Toshiko Satake, legal representative

(73) Assignee: Satake Corporation, Tokyo (JP)

( * ) Notice: Subject to any disclaimer, the term of this patent is extended or adjusted under 35 U.S.C. 154(b) by 0 days.

(21) Appl. No.: 09/875,781

(22) Filed: Jun. 6, 2001

(30) Foreign Application Priority Data

Jun. 7, 2000 (JP) ..... 2000-170066

(51) Int. Cl.[7] ..... B02B 3/00; B02B 3/02; B02B 3/04; B02B 3/06; A23L 1/00

(52) U.S. Cl. ..... 99/488; 99/519; 99/523; 99/524; 99/609; 99/618; 99/620; 99/621

(58) Field of Search ..... 99/486, 488, 489, 99/600, 518, 519, 523–525, 609–611, 612–615, 617–622, 623–625; 241/7, 11, 14, 37, 42, 49, 74, 257.1; 426/481–483, 518

(56) References Cited

U.S. PATENT DOCUMENTS

| | | | | | |
|---|---|---|---|---|---|
| 3,885,464 | A | * | 5/1975 | Ceballos-Aguilera | 99/600 X |
| 3,960,068 | A | * | 6/1976 | Salete | 99/610 X |
| 3,995,542 | A | * | 12/1976 | Miecke | 99/569 |
| 4,194,445 | A | * | 3/1980 | Gemsjager | 99/523 X |
| 4,196,224 | A | * | 4/1980 | Falk | 426/483 |
| 4,292,890 | A | * | 10/1981 | Salete-Garces | 99/610 X |
| 4,693,903 | A | * | 9/1987 | Halwani | 99/518 X |
| 5,048,407 | A | * | 9/1991 | Salete-Garces | 99/519 |
| 5,050,808 | A | * | 9/1991 | Satake et al. | 241/37 |
| 5,209,158 | A | * | 5/1993 | Salete-Garces | 99/617 X |
| 5,295,629 | A | * | 3/1994 | Satake et al. | 241/74 X |
| 5,415,085 | A | * | 5/1995 | Thomson | 99/574 |
| 5,678,477 | A | | 10/1997 | Satake et al. | |
| 5,752,664 | A | * | 5/1998 | Satake et al. | 241/74 |
| 5,873,301 | A | | 2/1999 | Satake et al. | |

FOREIGN PATENT DOCUMENTS

| | | | |
|---|---|---|---|
| EP | 0 771 590 | 5/1997 | B02B/3/04 |
| EP | 0 820 814 | 1/1998 | B02B/3/04 |
| JP | 09-313959 | 12/1997 | |

* cited by examiner

*Primary Examiner*—Timothy F. Simone
(74) *Attorney, Agent, or Firm*—Darby & Darby

(57) ABSTRACT

A husking apparatus supplies cereal grains between a pair of rotating rubber rolls through a guiding chute, rubs and husks them. A roll diameter marker for indicating an abrasion degree of the diameter of one of the rubber rolls is provided near the minimum gap between the rubber rolls. An incline angle changing marker previously marked with a changing degree of a position or an angle of incline of the guiding chute in correspondence to the roll diameter marker is provided near the lower end of the guiding chute. An operator can readily detect the diameter of the rubber roll by means of the roll diameter marker and accurately set the position or the angle of incline of the guiding chute in accordance with the incline angle changing marker.

18 Claims, 5 Drawing Sheets

HUSKING APPARATUS

BACKGROUND OF THE INVENTION

The present invention relates to a husking apparatus for cereal grains.

A conventional husking apparatus has a pair of rubber rolls whose distance can be adjusted, and a supply tank provided thereabove. Cereal grains are supplied between the pair of rubber rolls from the tank via a feeding roll and a flow rate adjusting valve. The robber rolls rotate in opposite directions to each other at different peripheral speeds so as to husk. In this case, the cereal grains from the supply tank are fed only via the feeding roll and the flow rate adjusting valve. Accordingly, the cereal grains are supplied between the rubber rolls while assuming different postures and forming thick multiple layers, and are husked due to a pressure and rotation applied by the rolls when passing between the rolls.

Japanese Patent Application Laid-Open Publication No. H9-313959 to the same assignee as that of the present case discloses a husking apparatus in which provided above a pair of rubber rolls are a guiding chute for supplying cereal grains between the pair of rubber rolls and a feeder for transporting the cereal grains from a supply tank to the guiding chute by means of vibrations. The feeder forms the cereal grains in a thin, belt-like layer and supplies them to the guiding chute. Further, the guiding chute is inclined to arrange the length or longitudinal direction of the cereal grains in a direction-of movement while accelerating them and supply them, which are in the belt-like thin layer, between the rubber rolls. This configuration enables the cereal grains in the thin belt-like layer supplied between the rubber rolls to be equally subject to the action of the rubber rolls, and a husking operation can be securely performed.

Japanese Patent Application Laid-Open Publication No. H9-313959 further proposes, in claim 7, providing a sensor to detect any one of the diameters of the pair of rubber rolls. This is the configuration devised in consideration of the case where as the pair of rubber rolls are used, they are worn away, the diameters thereof are reduced and a position of the minimum gap between the rubber rolls moves. The position or the angle of incline of the guiding chute is changed in accordance with the diameter of the rubber roll detected by the sensor so as to adjust a flying track of the cereal grains thrown out from the guiding chute. Accordingly, it is possible to change a position for throwing the cereal grains in correspondence to the change of the minimum gap between the rubber rolls, thereby effectively performing a husking operation.

The above husking apparatus is convenient since the angle of incline of the guiding chute is automatically set. On the other hand, a contact roller and a photoelectric sensor for detecting a position of rotation of the contact roller are required as a sensor for detecting the diameter of the rubber roll. Therefore, the structure becomes complex and the manufacturing cost is increased.

SUMMARY OF THE INVENTION

The present invention has, in view of the above problems, an object of providing a husking apparatus in which the position or the angle of incline of a guiding chute can be manually and accurately set.

Another object of the invention is to provide a husking apparatus in which the diameter of a rubber roll can be easily detected with a simple structure and the position or the angle of incline of a guiding chute can be accurately set.

The husking apparatus according to the invention comprises a pair of rubber rolls provided to have therebetween a gap adjustable, rotated in opposite directions to each other at different peripheral speeds and having rotational axes at different heights, a guiding chute disposed above the rubber rolls and having a position or an angle of incline manually changeable for arranging cereal grains in a belt-like state and supplying them between the rubber rolls, and a transportation system for feeding the cereal grains to the guiding chute. This apparatus is characterized in that a roll diameter marker is provided near a position of the minimum gap between the pair of rubber rolls for visually indicating the abrasion degree of the diameter in one of the pair of rubber rolls to an operator, and an incline angle changing marker previously marked with the change degree of the position or the angle of incline of the guiding chute in correspondence to the roll diameter marker is provided near the lower end of the guiding chute.

The pair of rubber rolls are worn away as they are used, the diameters thereof are reduced, and the position of the minimum gap between the rubber rolls is changed in accordance with the reduction of the diameters. It is necessary to manually move the guiding chute in a parallel direction or vary the angle of incline in correspondence to the change of the minimum gap so as to alter the position for throwing in the cereal grains. In the apparatus of the invention, the incline angle changing marker, which indicates the change degree of the position or the angle of incline of the guiding chute in correspondence to the roll diameter marker, is provided near the lower end of the guiding chute. The position or the angle of incline of the guiding chute is manually changed in accordance with the incline angle changing marker.

The apparatus of the invention, since the position or the angle of incline of the guiding chute is thus manually changed, requires no components for the automatic adjustment such as the sensor for detecting the diameter of the rubber roll, the contact sensor and the like. Accordingly, the configuration is simple, and it is possible to accurately set the position or the angle of incline of the guiding chute.

Preferably, the pair of rubber rolls and the guiding chute are arranged so that an imaginary line connecting the rotational axes of the rubber rolls is substantially perpendicular to the flying track of the cereal grains thrown out from the guiding chute. With this arrangement, the cereal grains less bounce back at the rubber rolls to be disturbed in their postures when they are supplied to the pair of rubber rolls, and the occurrence of breakage of the grains can be prevented.

It is preferable for the apparatus to further comprise a machine casing for receiving the pair of rubber rolls and a safety cover for covering the rubber rolls, in which a roll inspection window and a guiding chute inspection window are formed. In this case, the roll diameter marker and the incline angle changing marker are respectively provided on the roll inspection window and the guiding chute inspection window. With this configuration, it is possible to monitor the abrasion degree of the diameters of the rubber rolls in a state of closing the safety cover and to change the position or the angle of incline of the guiding chute in correspondence to the abrasion degree of the diameters of the rubber rolls while keeping the safety cover closed.

Alternatively, the apparatus may have a plate for preventing the cereal grains from flowing out from the end surfaces of the rubber rolls, which is provided near the position of the minimum gap between the pair of rubber rolls, in addition to the machine casing and the safety cover described above. In this case, the roll diameter marker and the incline angle changing marker are mounted on the flowing-out preventing plate. The flowing-out preventing plate is so arranged that the roll diameter marker can be viewed through the roll inspection window and the incline angle changing marker can be viewed through the guiding chute inspection window. With this configuration, it is possible to visually compare the roll diameter marker with the diameter of the rubber roll at the position near the end surface of the rubber roll to accurately measure the abrasion degree. Similarly, since the incline angle changing marker is mounted at the position near the guiding chute, the position or the angle of incline of the guiding chute can be accurately changed.

The roll diameter marker preferably indicates the abrasion degree in a plurality of sections divided on the basis of the diameter of a new rubber roll, and the incline angle changing marker preferably indicates the changing degree of the position or the angle of incline of the guiding chute in a plurality of sections divided in correspondence to the roll diameter marker. With this configuration, it is possible that a remaining thickness of the diameter of the roll can be instantaneously known so as to adjust the position or the angle of incline of the guiding chute.

Preferably, the roll diameter marker classifies the abrasion degree into three levels and distinguishes them by color, and the incline angle changing marker also classifies the changing degree of the position or the angle of incline of the guiding chute into three levels and distinguishes them by color in correspondence to the roll diameter marker. In this case, the classifications of the abrasion and the changing degree are not many, and it is not required to frequently change the position or the angle of incline of the guiding chute. The position or the angle of incline of the guiding chute can be easily and accurately adjusted in accordance with the level of the remaining thickness of the diameter of the roll.

Further, the roll diameter marker can indicate a sign for replacing timing of the rubber rolls. With this indication, the replacement of the rubber roll on the stationary side and that on the movable side with each other can be done at an accurate timing, and it is possible to prolong the service life of the rubber rolls.

BRIEF DESCRIPTION OF THE DRAWINGS

The above and other features and advantages of the invention will be apparent from the description which will be given below with reference to the accompanying drawings, in which.

DESCRIPTION OF THE PREFERRED EMBODIMENTS

Figure 1:
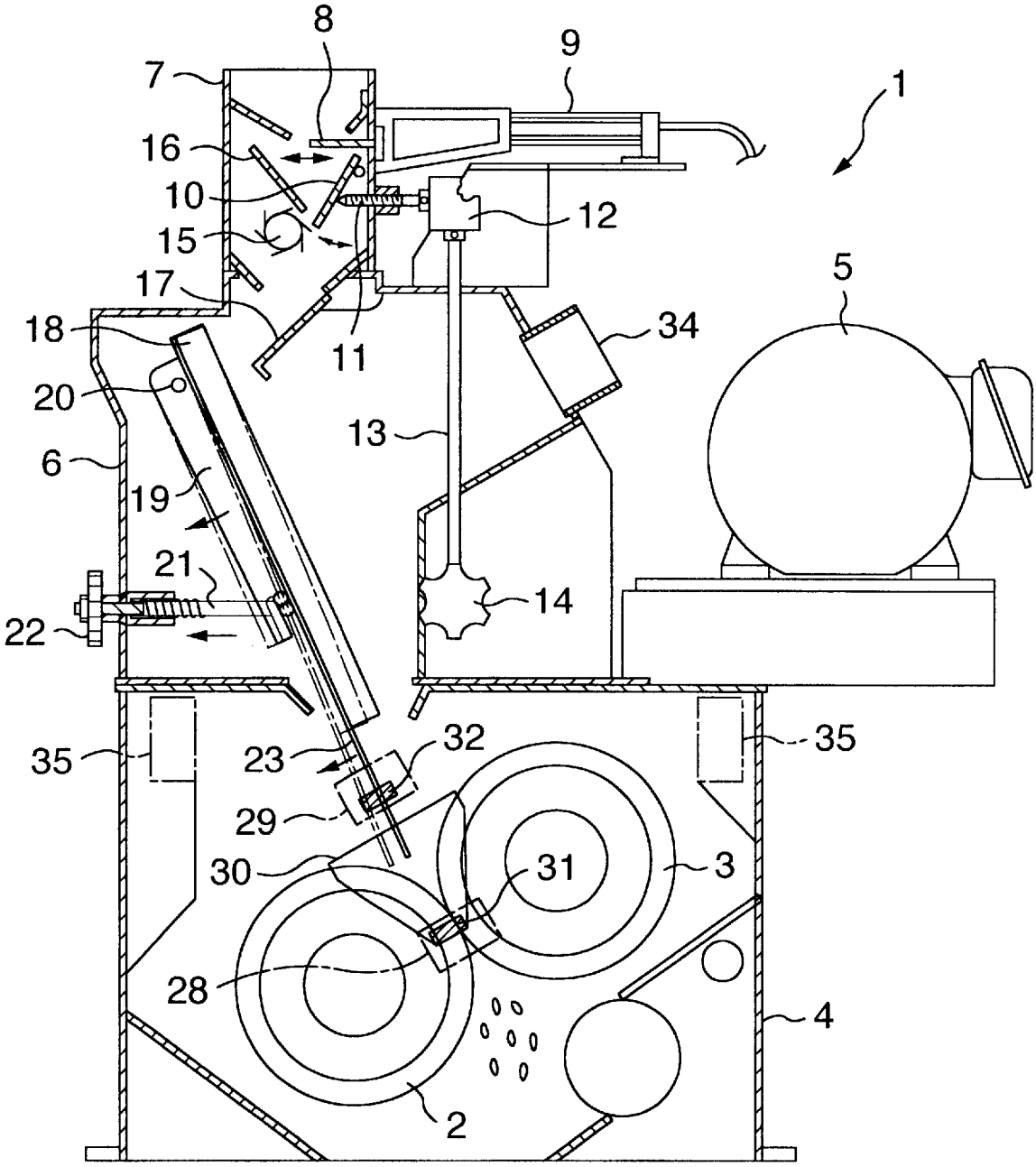
FIG. 1 is a vertical section view of the husking apparatus according to an embodiment of the invention.

FIG. 1 shows a husking apparatus 1 according to an embodiment of the invention, which has a pair of rubber rolls 2 and 3. The rubber rolls are rotatably journaled within a machine casing 4 so that one roll can be adjusted to move close to or apart from the other roll. The rubber rolls 2 and 3 are connected to a drive motor 5 by a belt (not shown) and are so constructed as to be rotated in opposite directions to each other at different peripheral speeds. The rolls are the same as those of a conventional husking apparatus in this respect.

An upper machine casing 6 is mounted on the machine casing 4, and a supply tank 7 for storing cereal grains is provided in an upper portion of the machine casing 6. A shutter 8 for supplying the cereal grains from the supply tank 7 into the machine is provided in the middle of the supply tank 7. The shutter 8 is adapted to be opened and closed under the on-off control of an air cylinder 9 which is provided on a side of the supply tank 7. A flow rate adjusting valve 10 is provided under the shutter 8. An opening degree of the flow rate adjusting valve 10 is controlled by moving a screw rod 11 inward to or outward from the tank 7. The screw rod 11 is rotated by turning an adjusting handle 14 connected to a gear box 12 and a rod 13. A feeding roll 15 rotated by suitable drive means is provided as transportation means for feeding the cereal grains to a guiding chute, which will be described later, below the flow rate adjusting valve 10. The rotation of the feeding roll 15 enables supply of the cereal grains while preventing them (unhulled rice) from causing a bridge between the flow rate adjusting valve 10 and a downspout 16. Reference numeral 17 denotes a supply downspout for supplying the cereal grains dropping down from the feeding roll 15 to the guiding chute described below.

Provided below the lower end of the supply downspout 17 is the guiding chute 18 for sending the cereal grains dropping from the feeding roll 15 to a portion between the pair of rolls 2 and 3. The guiding chute is arranged within the upper machine casing 6 to be supported by a chute frame 19 at a predetermined angle of incline. The chute frame 19 is pivoted at its upper end about a support shaft 20, and the lower end of the chute frame is connected to an adjusting rod 21. Accordingly, the angle of incline of the guiding chute 18 is adjusted by turning a handle 22 of the adjusting rod 21. A slide flow plate 23 is connected to the lower end of the guiding chute 18. The angle of incline of the guiding chute is adjusted by the adjusting rod 21 so that the slide plate 23 is directed toward a gap between the pair of rubber rolls 2 and 3.

By the way, the width (in the vertical direction to the plane of the drawing) of the guiding chute 18 and that of the slide plate 23 are set to be substantially equal to the width of the pair of rubber rolls 2 and 3. Incidentally, alternatively to changing the angle of incline through the provision of the support shaft 20 in the guiding chute frame 19, it is possible to move the entire guiding chute frame 19 in a parallel direction to change the position thereof.

The apparatus 1 is constructed such that a flying track of the cereal grains thrown out from the guiding chute 18 is substantially vertical to an imaginary line connecting the center axes of rotation of the pair of rubber rolls 2 and 3. With this configuration, the cereal grains less bounce back at the rubber rolls 2, 3 to be disturbed in their postures at the time when they are supplied to the pair of rubber rolls 2 and 3, and it is possible to prevent breakage of the grains from occurring.

Figure 2:
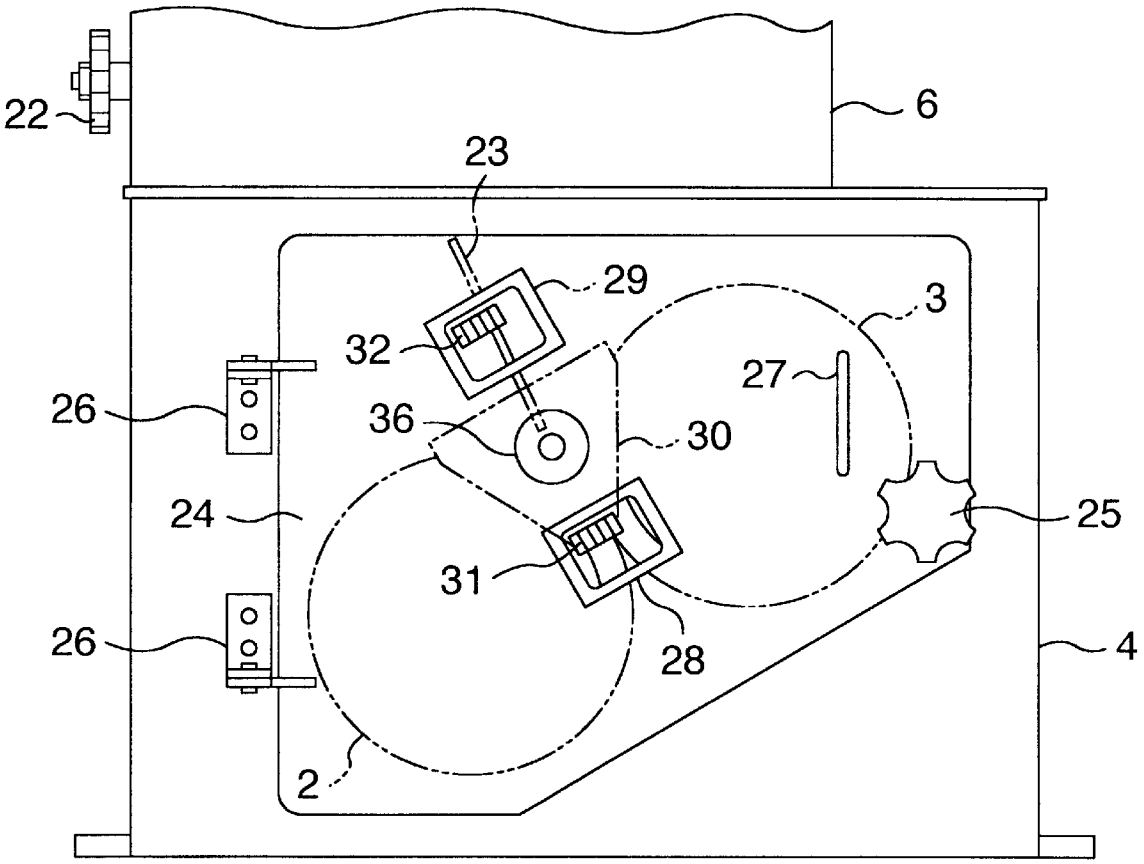
FIG. 2 is a front view showing an essential portion of the husking apparatus of FIG. 1.
Figure 3:
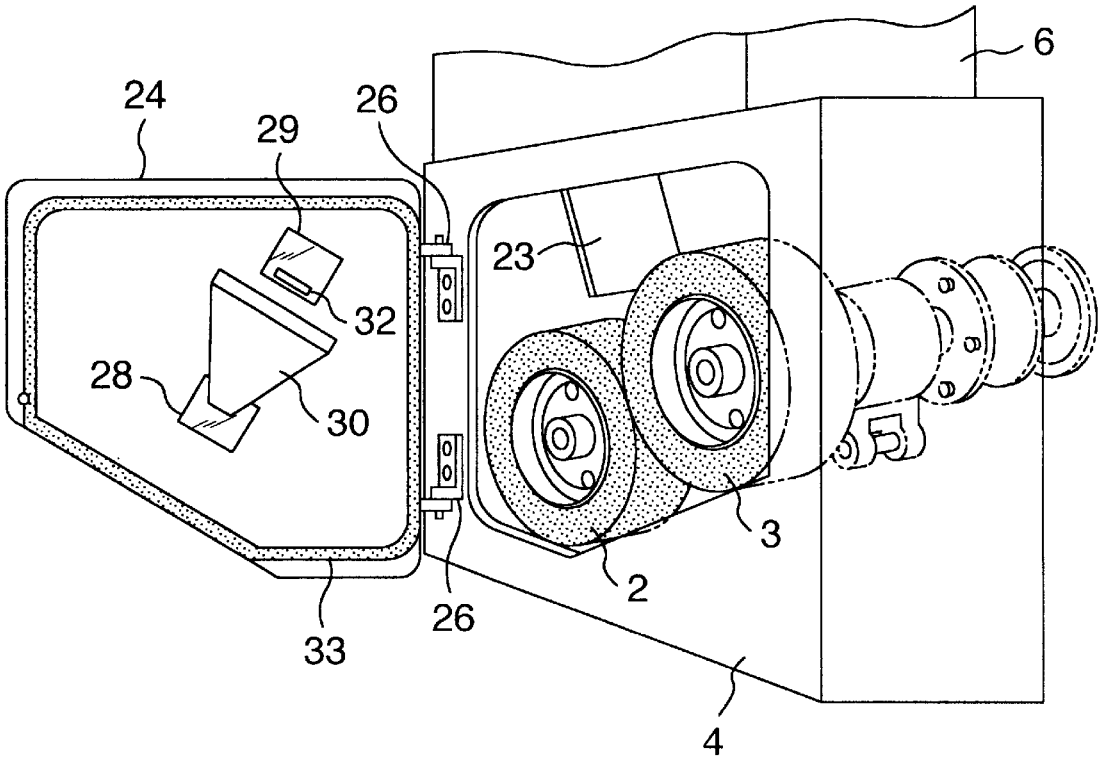
FIG. 3 is a schematic perspective view showing the essential portion of the husking apparatus of FIG. 1 in a state of opening a safety cover of a machine casing in which a pair of rubber rolls are received.

Referring to FIGS. 2 and 3, a safety cover 24 is provided on the machine casing 4 in which the rubber rolls 2 and 3 are received. A screw handle 25 is mounted to the safety cover 24, and when the handle is loosened, the safety cover 24 is opened from the machine casing 4 while being supported by hinges 26, 26. Opening of the safety cover 24 causes the rubber rolls 2 and 3 to be exposed, and the replacement of them can be easily done.

The safety cover 24 has a roll inspection window 28 and a guiding chute inspection window 29 formed therein. The roll inspection window 28 and the guiding chute inspection window 29 are respectively open at a position capable of viewing the outer circumference of the roll 2 and at a position capable of viewing the incline of the sliding flow plate 23 of the guiding chute. These inspection windows are covered with transparent material for preventing the cereal grains or foreign materials from coming in and out. Further, a roll diameter marker 31 for indicating an abrasion degree of the diameter of the rubber roll is provided on the roll inspection window 28. On the guiding chute inspection window 29, an incline angle changing marker 32 on which previously marked is a changing degree of a position or an angle of incline of the guiding chute 18 in correspondence to the roll diameter marker 31, is provided.

With this configuration, an operator can compare the diameter of the rubber roll 2 with the roll diameter marker 31 to monitor the abrasion degree of L the diameter of the rubber roll 2 in the state of closing the safety cover 24. Further, it is possible to visually compare the incline angle changing marker 32 with the guiding chute 18 to change the position or the angle of incline of the guiding chute 18 in correspondence to the abrasion degree of the diameter of the rubber roll 2 while keeping the safety cover 2 closed.

In this embodiment, a plate for preventing the cereal grains from flowing out from the end surfaces of the rubber rolls near the minimum gap is installed on the safety cover 24, and the roll diameter marker 31 is mounted on the flowing-out preventing plate 30. On the other hand, the incline angle changing marker 32 is adhered to the guiding chute inspection window 29. Accordingly, it is possible to accurately measure the abrasion degree by visually comparing the roll diameter marker 31 with the diameter of the rubber roll 2 at a portion close to the end surface of the rubber roll.

Alternatively, both the roll diameter marker 31 and the incline angle changing marker 32 may be mounted on the flowing-out preventing plate 30. In this case, it is preferable to arrange the roll diameter marker 31 and the incline angle changing marker 32 in such a manner that the former is monitored through the roll inspection window 28 and the later is monitored through the guiding chute inspection window 29. With this modification, similarly to the roll diameter marker 31, the incline angle changing marker 32 is also mounted on the portion close to the guiding chute 18, thereby enabling an accurate change of the position or the angle of incline of the guiding chute 18.

Incidentally, reference numeral 33 denotes a gap tape adhered to the outer periphery of the safety cover 24, which serves to increase a sealing performance at a time of closing the safety cover 24. Further, reference numeral 34 in FIG. 1 denotes a suction port for sucking dusts or the like scattering during the husking operation, and reference numeral 35 denotes an air intake port for taking in the external air. Reference numeral 36 in FIG. 2 denotes a dial for adjusting a distance between the flowing-out preventing plate 30 and the end surfaces of the rubber rolls 2 and 3, and reference numeral 27 denotes a grip for opening the safety cover 24.

Figure 4:
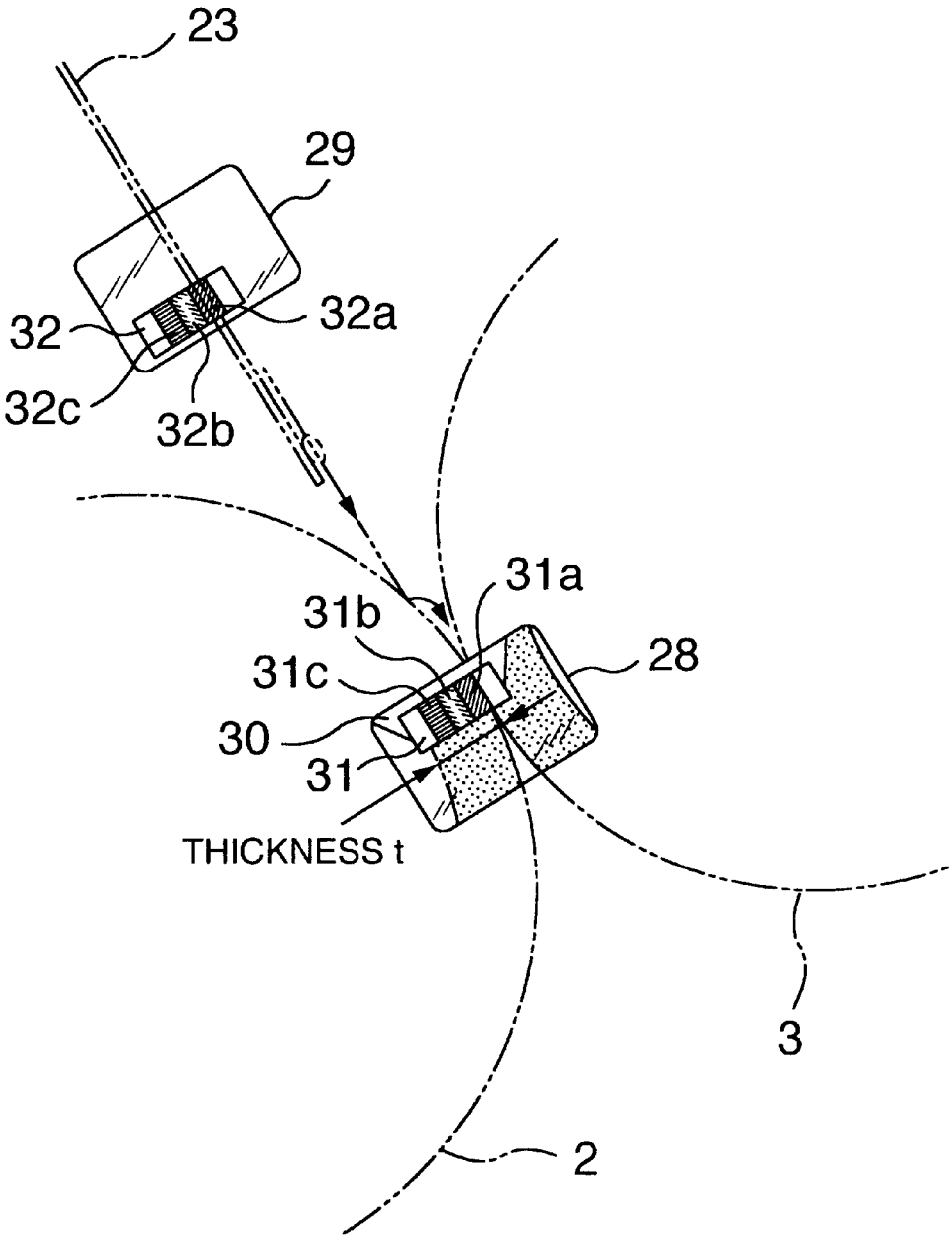
FIG. 4 is an enlarged view showing a roll diameter marker and an incline angle changing marker in the apparatus of FIG. 1.

The roll diameter marker 31 for indicating the abrasion degree of the rubber rolls 2 and 3 may be a sticker which displays, for instance, provided that the diameter of a new rubber roll (a thickness t of the rubber roll) is 21 mm, the thickness t while dividing it into three sections 31*a*, 31*b* and 31*c* arranged from the outer side and each having 7 mm width, as shown in FIG. 4. In this case, the markers 31*a*, 31*b* and 31*c* can be easily distinguished by using different colors blue, yellow and red for the markers 31*a*, 31*b* and 31*c*, respectively. The roll diameter marker 31 is attached to the flowing-out preventing plate 30 and arranged so that the outer periphery of the roll 2 and the outer edge of the marker 31*a* can be seen in line with each other through the roll window 28.

Similarly, the incline angle changing marker 32 may be a sticker which displays the position of the guiding chute while dividing it into three sections in correspondence to the roll diameter marker 31, and be disposed on the guiding chute inspection window 29. More specifically, three markers 32*a*, 32*b* and 32*c* are provided from a gentle angle of incline of the guiding chute toward a sharp angle of incline. In this case, in the same manner as the roll diameter marker 31, the markers 32*a*, 32*b* and 32*c* can be easily distinguished by using different colors blue, yellow and red for the markers 32*a*, 32*b* and 32*c*, respectively.

Figure 6A:
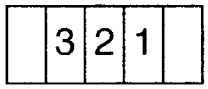
FIGS. 6A to 6C respectively show different modifications of indications on the roll diameter marker and the incline angle changing marker.
Figure 6B:
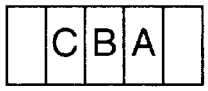
Figure 6C:
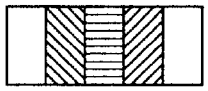

Alternatively, another means for increasing the distinguish ability of the markers 31 and 32 may be employed. FIG. 6A shows an example using Arabic numerals in the markers, FIG. 6B shows another example in which alphabetical letters are employed in the markers, and FIG. 6C shows still another example in which patterns capable of distinguishing the respective markers are attached to the markers.

Description will be now given of an operation of the husking apparatus constructed as above. When power is turned on to drive the motor 5, the pair of rubber rolls 2 and 3 rotate in opposite directions to each other at different peripheral speeds. Then, the air cylinder 9 is turned on to open the shutter 8, and the flow rate adjusting valve 10 is controlled to drive the feeding roll 15. Accordingly, the cereal grains (unhulled rice) fed from the supply tank 7 get into a belt-like state and drop down onto the guiding chute 18. The dropped cereal grains (unhulled rice) slide down along the guiding chute 18, and during sliding, they are adjusted of their postures so that the length or longitudinal direction of the cereal grains (unhulled rice) becomes parallel to the sliding-down direction. As a result, at the time when the cereal grains (unhulled rice) drop down between the pair of rubber rolls 2 and 3 from the slide plate 23, almost all the cereal grains (unhulled rice) are supplied in the state of being arranged in the longitudinal direction and being in a belt-like slayer of the same width as that of the rubber rolls 2 and 3. At this time, since the safety cover 24 is closed and the flowing-out preventing plate 30 is close to the end surfaces of the rubber rolls 2 and 3, the cereal grains do not flow out from the rubber rolls 2 and 3 and are rubbed and husked due to the pressure by the rolls and the difference of peripheral speeds thereof.

Figure 5:
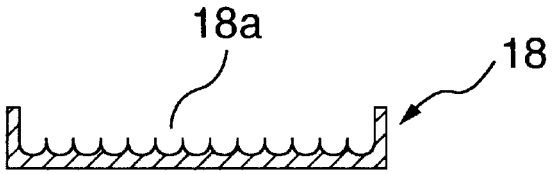
FIG. 5 is a section view showing the guiding surface of a guiding chute in the apparatus of FIG. 1.

The guiding chute 18 is set to have a length and an incline which cause the cereal grains (unhulled rice) to drop down along the guiding chute and be accelerated to a speed close to the speed of free-fall at the time of being supplied between the rubber rolls 2 and 3. A supply rate of the cereal grains (unhulled rice) is adjusted to be substantially 2 m/sec to 5 m/sec. The cereal grains are accelerated by the guiding chute 18 and supplied between the rubber rolls 2 and 3 in the state of a belt-like thin layer. As a result, the effect of the rubber rolls 2 and 3 equally acts on each one of the cereal grains (unhulled rice), and a husking operation is uniformly carried out to effectively husk the cereal grains. In order to make more reliable the arranging of the cereal grains (unhulled rice) in the longitudinal direction by the guiding chute 18, rows of grooves 18*a* may be formed in the guiding surface of the guiding chute 18, as shown in FIG. 5.

As described above, since the cereal grains (unhulled rice) are accelerated and supplied by the guiding chute 18, when the throwing-in point of the cereal grains is shifted from the minimum gap between the rubber rolls 2 and 3, they (unhulled rice) bounce back at the rubber rolls 2 and 3. In order to avoid this, the cereal grains (unhulled rice) has to be supplied to the point where the gap between the rubber rolls 2 and 3 becomes as minimum as possible, and it is difficult to set the angle of incline of the guiding chute 18. Further, the rubber rolls 2 and 3 are worn away every hour as being used, and the point where the gap between the rolls is minimum gradually moves. Accordingly, it is further hard to supply the cereal grains (unhulled rice) from the guiding chute 18 to the point where the gap between the rolls 2 and 3 becomes minimum.

In view of this, in the husking apparatus according to the invention, the guiding chute 18 and the rubber rolls 2 and 3 are arranged so that a dropping track of the cereal grains (unhulled rice) sliding down from the guiding chute 18 is substantially perpendicular to the imaginary line connecting the axes of rotation of the rubber rolls 2 and 3 and the cereal grains from the guiding chute 18 are thrown to the point where the gap between the rubber rolls 2 and 3 is minimum. The position or the angle of incline of the guiding chute 18 is set as described above at the time of shipping the product or apparatus, however, the rubber rolls 2 and 3 are worn away as they are used, particularly, the stationary side roll 2 rotating at a high speed tends to be worn away, so that the optimum position or angle of incline of the guiding chute 18 is shifted. More particularly, the abrasion of the rubber rolls 2 and 3 causes the movable side rubber roll 3 to move toward the stationary side in correspondence to a reduction of the diameter of the stationary side rubber roll 2.

In the conventional apparatus in which the position or the angle of incline of the guiding chute 18 is manually adjusted, the adjustment is carried out through estimation with the eye and is often lacking in accuracy. On the other hand, in the case that the adjustment is automatically performed, a contact roller and a photoelectric sensor for detecting the rotational position of the contact roller are required as a sensor for detecting the diameter of a rubber roll, so that the structure becomes complex and the manufacturing cost is increased.

In accordance with the invention, the roll diameter marker 31 for indicating the abrasion degree of the diameters of the rubber rolls 2 and 3 is arranged so as to be monitored through the roll inspection window 28. Further, the incline angle changing marker 32 for indicating the changing degree of the position or the angle of incline of the guiding chute 18 in correspondence to the roll diameter marker 31 is provided in the guiding chute window 29.

By the way, the stationary side roll 2 rotates at a higher speed and is worn away earlier than the movable roll 3 which rotates at a lower speed, and it is preferable that the roll diameter marker 31 is provided on the stationary roll 2 side. In this case, when the rubber roll 2 is new, the outer diameter thereof corresponds to the blue section 31*a* of the roll diameter marker 31, however, when the rubber roll 2 is worn away and the outer diameter thereof gets in the yellow section 31*b*, the position of the gap between the rubber rolls 2 and 3 moves to the side of the stationary roll 2. Then, the operator only has to change the position or the angle of incline of the guiding chute 18 to the yellow section 32*b* from the blue section 32*a*, counting on the incline angle changing marker 32, in correspondence to the movement of the outer diameter of the roll from the blue section 31*a* to the yellow section 31*b*. When the rubber roll 2 is further worn away and the outer diameter gets in the red section 31*c* from the yellow section 31*b*, the thickness of the roll becomes substantially one half or less of the new one, and this may be regarded as a guideline for replacing the stationary side roll 2 with the movable side roll 3. After replacing the rolls with each other, it is also necessary to always monitor the outer diameter of the stationary side roll 2 and the roll diameter marker 31 and change the position or the angle of incline of the guiding chute 18 on the basis of the incline angle changing marker 32, in accordance with the corresponding color section of the marker 31.

As having described above, in accordance with the invention, the roll diameter marker for indicating the abrasion degree of the diameter of any one of the rubber rolls is provided near the position of the minimum gap between the pair of rubber rolls. Further, the incline angle changing marker, on which previously marked is the changing degree of the position or the angle of incline of the guiding chute in correspondence to the roll diameter marker, is provided near the lower end of the guiding chute. With this configuration, the components for automatically adjusting the incline of the guiding chute such as a sensor for detecting the diameter of the rubber roll, a contact roller or the like become unnecessary, and it is possible to accurately set the position or the angle of incline of the guiding chute with a simple structure.

The invention has been described on the basis of the embodiments, however, it should be understood that the invention is not limited solely to the specific forms and can be variously modified within the scope of the attached claims, or the invention can take other forms.

What is claimed is:

1. A husking apparatus comprising:

a pair of rubber rolls provided to be adjustable of a gap therebetween, the rubber rolls being rotated in opposite directions to each other at different peripheral speeds and having rotational axes at different heights;

a guiding chute arranged above the pair of rubber rolls, the guiding chute having a position or an angle of incline manually changeable for arranging cereal grains in a belt-like state and supplying the cereal grains between the rubber rolls;

transportation means for feeding the cereal grains to the guiding chute;

a roll diameter marker provided near a position of the minimum gap between the pair of rubber rolls for visually indicating an abrasion degree of a diameter of one of the pair of rubber rolls to an operator; and an incline angle changing marker provided near a lower end of the guiding chute, the incline angle changing marker being previously marked with a change degree of the position or the angle of incline of the guiding chute in correspondence to the roll diameter marker.

2. The apparatus claimed in claim 1, wherein the pair of rubber rolls and the guiding chute are arranged so that an imaginary line connecting rotational axes of the rubber rolls is substantially perpendicular to a flying track of the cereal grains thrown out from the guiding chute.

3. The apparatus claimed in claim 1, further comprising a machine casing for receiving the pair of rubber rolls and a safety cover provided on the machine casing to cover the pair of rubber rolls, wherein the safety cover has a roll inspection window and a guiding chute inspection window formed therein, and the roll diameter marker and the incline angle changing marker are respectively disposed on the roll inspection window and the guiding chute inspection window.

4. The apparatus claimed in claim 2, further comprising a machine casing for receiving the pair of rubber rolls and a safety cover provided on the machine casing to cover the pair of rubber rolls, wherein the safety cover has a roll inspection window and a guiding chute inspection window formed therein, and the roll diameter marker and the incline angle changing marker are respectively disposed on the roll inspection window and the guiding chute inspection window.

5. The apparatus as claimed in claim 1, further comprising a machine casing for receiving the pair of rubber rolls, a safety cover provided on the machine casing to cover the pair of rubber rolls and a plate provided near a position of a minimum gap between the pair of rubber rolls for preventing the cereal grains from flowing out from end surfaces of the rubber rolls, wherein the safety cover has a roll inspection window and a guiding chute inspection window formed therein, the roll diameter marker and the incline angle changing marker are mounted on the flowing-out preventing plate, and the flowing-out preventing plate is arranged so that the roll diameter marker can be viewed through the roll inspection window and the incline angle changing marker can be viewed through the guiding chute inspection window.

6. The apparatus as claimed in claim 2, further comprising a machine casing for receiving the pair of rubber rolls, a safety cover provided on the machine casing to cover the pair of rubber rolls and a plate provided near a position of a minimum gap between the pair of rubber rolls for preventing the cereal grains from flowing out from end surfaces of the rubber rolls, wherein the safety cover has a roll inspection window and a guiding chute inspection window formed therein, the roll diameter marker and the incline angle changing marker are mounted on the flowing-out preventing plate, and the flowing-out preventing plate is arranged so that the roll diameter marker can be viewed through the roll inspection window and the incline angle changing marker can be viewed through the guiding chute inspection window.

7. The apparatus claimed in claim 3, wherein the roll diameter marker indicates the abrasion degree while dividing the abrasion degree into a plurality of sections based on a diameter of a new rubber roll, and the incline angle changing marker indicates the changing degree of the position or the angle of incline of the guiding chute while dividing the change degree into a plurality of sections in correspondence to the roll diameter marker.

8. The apparatus claimed claim 4, wherein the roll diameter marker indicates the abrasion degree while dividing the abrasion degree into a plurality of sections based on a diameter of a new rubber roll, and the incline angle changing marker indicates the changing degree of the position or the angle of incline of the guiding chute while dividing the change degree into a plurality of sections in correspondence to the roll diameter marker.

9. The apparatus claimed in claim 5, wherein the roll diameter marker indicates the abrasion degree while dividing the abrasion degree into a plurality of sections based on a diameter of a new rubber roll, and the incline angle changing marker indicates the changing degree of the position or the angle of incline of the guiding chute while dividing the change degree into a plurality of sections in correspondence to the roll diameter marker.

10. The apparatus claimed in claim 6, wherein the roll diameter marker indicates the abrasion degree while dividing the abrasion degree into a plurality of sections based on a diameter of a new rubber roll, and the incline angle changing marker indicates the changing degree of the position or the angle of incline of the guiding chute while dividing the change degree into a plurality of sections in correspondence-to the roll diameter marker.

11. The apparatus claimed in claim 7, wherein the roll diameter marker divides the abrasion degree into three sections and distinguishes the abrasion degree sections by color, and the incline angle changing marker divides the changing degree of the position or the angle of incline into three sections and distinguishes the changing degree sections by color in correspondence to the roll diameter marker.

12. The apparatus claimed in claim 8, wherein the roll diameter marker divides the abrasion degree into three sections and distinguishes the abrasion degree sections by color, and the incline angle changing marker divides the changing degree of the position or the angle of incline into three sections and distinguishes the changing degree sections by color in correspondence to the roll diameter marker.

13. The apparatus claimed in claim 9, wherein the roll diameter marker divides the abrasion degree into three sections and distinguishes the abrasion degree sections by color, and the incline angle changing marker divides the changing degree of the position or the angle of incline into three sections and distinguishes the changing degree sections by color in correspondence to the roll diameter marker.

14. The apparatus claimed in claim 10, wherein the roll diameter marker divides the abrasion degree into three sections and distinguishes the abrasion degree sections by color, and the incline angle changing marker divides the changing degree of the position or the angle of incline into three sections and distinguishes the changing degree sections by color in correspondence to the roll diameter marker.

15. The apparatus claimed in claim 11, wherein the roll diameter marker additionally indicates a guideline for replacing timing of the rubber rolls.

16. The apparatus claimed in claim 12, wherein the roll diameter marker additionally indicates a guideline for replacing timing of the rubber rolls.

17. The apparatus claimed in claim 13, wherein the roll diameter marker additionally indicates a guideline for replacing timing of the rubber rolls.

18. The apparatus claimed in claim 14, wherein the roll diameter marker additionally indicates a guideline for replacing timing of the rubber rolls.

* * * * *